US007975521B2

(12) United States Patent
Makino

(10) Patent No.: US 7,975,521 B2
(45) Date of Patent: Jul. 12, 2011

(54) BENDING TOOL FOR A BENDING PRESS

(76) Inventor: Osamu Makino, Fuchu (JP)

( * ) Notice: Subject to any disclaimer, the term of this patent is extended or adjusted under 35 U.S.C. 154(b) by 168 days.

(21) Appl. No.: 12/423,734

(22) Filed: Apr. 14, 2009

(65) Prior Publication Data

US 2010/0257914 A1 Oct. 14, 2010

(51) Int. Cl.
*B21D 5/01* (2006.01)
*B21D 37/10* (2006.01)

(52) U.S. Cl. ..... 72/389.4; 72/413

(58) Field of Classification Search ..... 72/380, 72/383, 389.1, 389.2, 389.4
See application file for complete search history.

(56) References Cited

U.S. PATENT DOCUMENTS 4,356,718 A * 11/1982 Makino ..... 72/389.4
4,918,971 A * 4/1990 Makino ..... 72/389.4

FOREIGN PATENT DOCUMENTS

JP 1271011 A 10/1989
JP 2008100265 5/2008

* cited by examiner

*Primary Examiner* — David B Jones
(74) *Attorney, Agent, or Firm* — Browdy and Neimark, PLLC

(57) ABSTRACT

A bending tool that may be used for bending elongated works and in which the works are not likely to be damaged is provided. An angle formed by a blade parting line L1 or L2 and an outside edge (e.g., 55 degrees) of each die (having an angle of a blade edge of, e.g., 90 degrees) is made larger than an angle formed by the blade parting line L1 or L2 and an inside edge (e.g., 35 degrees). The blade parting line L1 or L2 of one of the dies is located at a predetermined position further toward the blade parting line L2 or L1 of the other of the dies with respect to the center of the space between the blade parting line L2 or L1 and the inner end edge of the bending block.

4 Claims, 2 Drawing Sheets

BENDING TOOL FOR A BENDING PRESS

BACKGROUND OF THE INVENTION

1. Field of the Invention

The present invention relates to a bending tool mounted on a press bending machine (also called a press brake) for bending mechanical parts, such as a metal plate.

2. Description of the Related Art

Japanese Patent No. 1707773 discloses a bending tool proposed by the present applicant. The disclosed bending tool includes two dies, each of which includes a die body, a blade and a bending block. The blade is attached to an end of the die body. An edge of the blade has an angle of substantially 90 degrees that is bisected by a vertical blade parting line (i.e., a center line) The bending block is disposed adjacent to the blade with an adjustable space formed therebetween. The bending block and the blade altogether define a space along a direction substantially perpendicular to an edge surface of the blade. These dies oppose each other with the blade parting line of the first die being located at the center of the space between a blade parting line and a blade-side inner end edge of a bending block of the second die. A work (typically a metal plate) is placed on the lower die for a pressing operation. The blade edge of the upper die folds the work to the right angle at an area they are in contact with each other by pressing into the space formed adjacent to the blade of the lower die. The blade of the upper die is stopped when supported by an outside edge (which is a longer edge) of the blade edge and a chamfered face of the bending block. At the same time, the blade edge of the lower die folds the work to the right angle at an area they are in contact into the space formed adjacent to the blade of the upper die. The blade of the lower die is stopped when supported by an outside edge (which is a longer edge) of the blade edge and the chamfered face of the bending block. In this manner, a Z-shaped fitting is obtained.

In this bending tool, any one of the blade and the bending block is integrally formed with the die body and the other is provided separately. The separately provided one is fastened to the integrated one by a screw with a spacer disposed therebetween. The blade and the bending block are removably attached to the die body. Precise supporting surfaces of the blade and the bending block, which are press bending members, may be provided during production of the die body and thus a more precise bending tool may be provided. Since either the front side or the back side of the blade or the bending block is open when the die body operates, the bending tool is hardly interfered by projected portions on the die body, which may improve operational efficiency. If an edge of the removable blade or the bending block chips, the blade or the bending block may be removed and repaired, or may be replaced by an alternative part, which may be advantageous in maintenance. As described above, the related art bending tool has many advantageous effects.

The related art bending tool, however, has the following drawbacks.

(1) The blade of each die has the blade edge of substantially 90 degrees, which is bisected by the blade parting line. An angle formed by the blade parting line of each die and the edge outside with respect to the blade parting line equals to an angle formed by the blade parting line and the edge inside with respect to the blade parting line. The dies oppose each other with the blade parting line of the first die being located at the center of the space between the blade parting line and the blade-side inner end edge of the bending block of the second die. With this configuration, the work may be bent downward with respect to the horizontal direction from a folding point of the second, lower die to substantially 45 degrees. Thus, if the work is elongated (compared with a material to be processed of standard length), the work, especially the lower end thereof, may possibly collide with mechanical parts or the neighborhood thereof, which may hinder the bending operation. Most of the works to be processed with such a bending machine are elongated, however, and it is therefore needed to remove neighborhood obstacles to prevent collisions between (the lower end of) the work and (a part of) the bending machine. As a result, operational efficiency may be decreased.

(2) Since the bisected blade edge of each die folds the work to the right angle at an area they are in contact with each other by pressing into the space formed adjacent to the blade of the lower die, the work is bent in a rapid motion and may therefore be easily damaged. In addition, the work, especially the lower end thereof, is rapidly moved downward from the horizontal direction by 45 degrees, which may sometimes be unsafe to the operating personnel.

(3) Since the work is pressed with the blade edges of the dies misaligned with each other during a relative movement of the upper and the lower dies, it is likely that the dies are displaced from each other in the process of the pressing operation. Especially the lower die is more likely to be displaced since it is fastened to the table only with a screw. It is therefore difficult to elongate the metal mold or connect metal molds so as to extend the bending length.

In view of the aforementioned circumstances, an object of the invention is to provide a bending tool which may be used to reliably bend elongated (compared with materials to be processed of standard length) works without causing collisions with mechanical parts or the neighborhood thereof. Another object is to provide a bending tool in which the works are not likely to be damaged during the bending operation. A further object is to provide a bending tool which may be safe to the operating personnel. A still further object is to provide a bending tool in which misalignment of the dies may be reduced to improve machining precision. Yet another object is to provide a bending tool in which the metal mold may be elongated to increase the bending length.

SUMMARY OF THE INVENTION

To achieve the above objects, a first aspect of the invention is a bending tool for bending press which includes two dies each of which includes a die body, a blade and a press bending block, the blade being provided at an end of the die body and having a blade edge of predetermined angle which is bisected by a vertical blade parting line, the bending block and the blade altogether defining a space along a direction substantially perpendicular to an edge surface of the blade, and the dies opposing each other with the blade parting line of one of the dies being located at the center of the space between a blade parting line and a blade-side inner end edge of a bending block of the other of the dies, wherein: an angle formed by the blade parting line and the outside edge of each die is made larger than an angle formed by the blade parting line and the inside edge; and the blade parting line of one of the dies is located at a position further toward the blade parting line the other of the dies with respect to the center of the space between the blade parting line and the inner end edge of the bending block.

The inner end edge of the bending block may preferably be chamfered and the inside edge may preferably be shorter than the length of the chamfered face of the bending block.

The space between the blade and the bending block of one of the dies may preferably be increased such that the inner end edge of the bending block is located further outside the center with respect to the outside edge of the other of the dies.

The blade edge may preferably have an angle of substantially 90 degrees, an angle formed by the blade parting line and the outside edge may preferably be 55 degrees and an angle formed by the blade parting line and the inside edge may preferably be 35 degrees.

The bending tool according to an embodiment of the invention has the following advantageous effects.

(1) The angle formed by the blade parting line and the outside edge (e.g., 55 degrees) of each die (having an angle of the blade edge of, e.g., 90 degrees) is made larger than the angle formed by the blade parting line and the inside edge (e.g., 35 degrees). Each of the first and second dies is positioned such that the blade parting line is located at a position further toward the blade parting line of the opposing die with respect to the center of the space between the blade parting line and the inner end edge of the bending block of the opposing die. With this configuration, both ends of the work may be extended at the smallest angle with respect to the horizontal direction from a folding point during the folding operation. The space between the blade and the bending block of each of the first and second dies may be increased such that the inner end edge of the bending block may be located further outside the center with respect to the outside edge of the opposing die. With this configuration, the above-described advantageous effect may further be enhanced. With this bending tool, elongated works, compared with materials of standard length, may be reliably bent without causing collisions with mechanical parts or the neighborhood thereof.

(2) With this bending machine, the work, especially the lower end thereof, is gradually moved downward from the horizontal direction at a non-acute angle during the bending operation, which may be safe to the operating personnel. This advantageous effect may be enhanced if the space between the blade and the bending block of each of the first and second dies is increased such that the inner end edge of the bending block is located further outside the center with respect to the outside edge of the opposing die.

(3) During the relative movement of these dies, since the blade edges press the work at positions where they are close to each other, the dies are not likely to be displaced from each other during the pressing operation even if the lower die is fastened to the table only with a screw. Since the dies are not likely to be displaced from each other, the metal mold may be elongated or a plurality of metal molds may be connected so as to extend the bending length.

DESCRIPTION OF THE PREFERRED EMBODIMENTS

Figure 1:
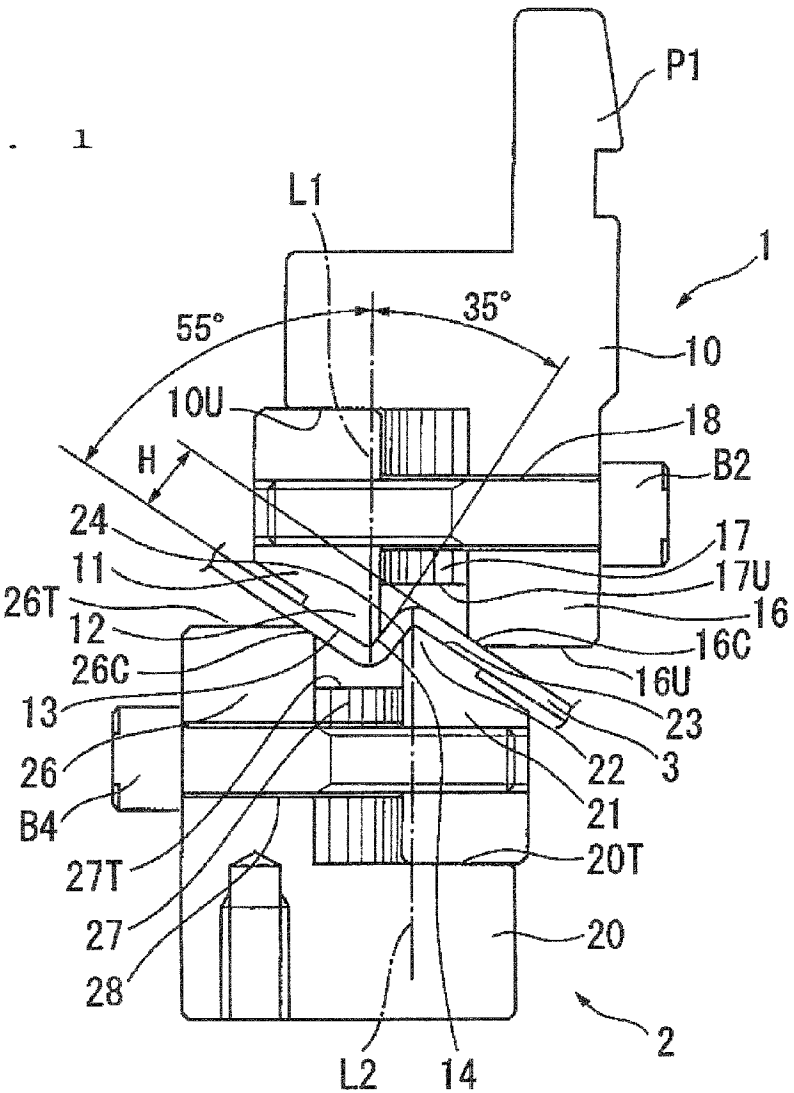
FIG. 1 is a side view of a bending tool for bending press according to an embodiment of the invention.

Referring now to the drawings, an embodiment of the invention will be described. As shown in FIG. 1, the bending tool includes an upper die 1 and a lower die 2.

The upper die 1 is fixed to a body of a press bending machine with a bolt or other fastening means at an upper end mounting section P1. The upper die 1 includes a die body 10, a blade 11 and a press bending block (hereinafter, referred to as a "bending block") 16. The blade 11 and the bending block 16, which are integrally formed with each other, are provided to protrude downward from an end (here, a lower end) of the die body 10. The blade 11 is a block body provided separately from the die body 10 and is removably attached to (a lateral end of) the bending block 16. The blade 11 and the bending block 16 altogether define an adjustable space along a direction substantially perpendicular to an edge surface 12 of the blade 11.

The bending block 16 has a substantially rectangular cross section and is formed as a rod extending in a direction perpendicular to the sheet of paper of FIG. 1. An inner end edge (i.e., a lower edge of an inner end surface) of the bending block 16 is a two-plane connecting section opposing an outside edge 23, which is located outside of a blade parting line L2 of the lower die 2. The inner end edge is chamfered to form a chamfered face 16C which is angled at 55 degrees and is parallel to the outside edge 23. A lower end surfaces 10U of the die body 10 other than the area at which the bending block 16 is formed is a flat surface extending from a base of the bending block 16 to a side edge of the die body 10. The blade 11 includes a blade edge 12, a long edge 13 and a short edge 14. The blade edge 12 has a predetermined angle that is bisected by a vertical blade parting line L1. The long edge 13 is located outside of the blade parting line L1 and the short edge 14 is located inside of the blade parting line L1 when seen in a cross sectional view. The blade edge 12 has an angle of substantially 90 degrees. An angle formed by the blade parting line L1 and the outside edge 13 is 55 degrees and an angle formed by the blade parting line L1 and the inside edge 14 is 35 degrees. The inside edge 14 is shorter than the length of the chamfered face 16C. A tip of the blade 11 is positioned to be on the substantially same plane of a lower end surface 16U of the bending block 16 when it abuts the lower end surface 10U of the die body 10. The blade 11 is disposed in a lateral direction of the bending block 16 with an adjustable space formed therebetween. A plurality of spacers 17 is disposed between the blade 11 and the bending block 16. Each of the spacers 17 is dimensioned such that the length in the height direction is shorter than the height of the bending block 16. A lower end 17U of each spacer 17 is positioned above the tip position of the blade 11 when the spacer 17 is made to abut the lower end surface 10U of the die body 10. A laterally extending screw hole 18 is formed across the blade 11, the spacers 17 and the bending block 16. A screw bolt B2 is inserted in the screw hole 18 and is fastened thereto. In this manner, the blade 11 is fastened to the bending block 16 with a space formed below the spacers 17, between the inner end surface of the blade 11 and the inner end surface of the bending block 16. The space between the blade 11 and the bending block 16 may preferably be increased such that the inner end edge of the bending block 16 is located further outside the center with respect to the outside edge 23 of the lower die 2.

The lower die 2 is placed on a table provided in the body of the bending machine and is fixed thereto with a bolt. The lower die 2 has the substantially same structure as that of the upper die 1 and includes a die body 20, a blade 21 and a bending block 26. The blade 21 and the bending block 26, which are integrally formed with each other, are provided to protrude upward from an end (here, a lower end) of the die body 20. The blade 21 is a block body provided separately from the die body 20 and is removably attached to (a lateral end of) the bending block 26. The blade 21 and the bending block 26 altogether define an adjustable space along a direction substantially perpendicular to an edge surface 22 of the blade 21.

The bending block 26 has a substantially rectangular cross section and is formed as a rod extending in a direction perpendicular to the sheet of paper of FIG. 1. An inner end edge (i.e., a lower edge of an inner end surface) of the bending block 26 is a two-plane connecting section opposing the outside edge 13, which is located outside of the blade parting line L1 of the upper die 1. The inner end edge is chamfered to form a chamfered face 26C which is angled at 55 degrees and is parallel to the outside edge 13. An upper end surfaces 20T of the die body 20 other than the area at which the bending block 26 is formed is a flat surface extending from a base of the bending block 26 to a side edge of the die body 20. The blade 21 includes the blade edge 22, a long edge 23 and a short edge 24. The blade edge 22 has a predetermined angle that is bisected by the vertical blade parting line L2. The long edge 23 is located outside of the blade parting line L2 and the short edge 24 is located inside of the blade parting line L2 when seen in a cross sectional view. The blade edge 22 has an angle of substantially 90 degrees. An angle formed by the blade parting line L2 and the outside edge 23 is 55 degrees and an angle formed by the blade parting line L2 and the inside edge 24 is 35 degrees. The inside edge 24 is shorter than the length of the chamfered face 26C. A tip of the blade 21 is positioned to be on the substantially same plane of an upper end surface 26T of the bending block 26 when it abuts the upper end surface 20T of the die body 20. The blade 21 is disposed in a lateral direction of the bending block 26 with an adjustable space formed therebetween. A plurality of spacers 27 is disposed between the blade 21 and the bending block 26. Each of the spacers 27 is dimensioned such that the length in the height direction is shorter than the height of the bending block 26. An upper end 27T of each spacer 27 is positioned above the tip position of the blade 21 when the spacer 27 is made to abut the upper end surface 20T of the die body 20. A laterally extending screw hole 28 is formed across the blade 21, the spacers 27 and the bending block 26. A screw bolt B4 is inserted in the screw hole 28 and is fastened thereto. In this manner, the blade 21 is fastened to the bending block 26 with a space formed above the spacers 27, between the inner end surface of the blade 21 and the inner end surface of the bending block 26. The space between the blade 21 and the bending block 26 may preferably be increased such that the inner end edge of the bending block 26 is located further outside the center with respect to the outside edge 13 of the upper die 1.

The upper die 1 and the lower die 2 of the bending tool are attached to the body of the bending machine so as to oppose each other. The blade parting line L1 of the upper die 1 is located at a predetermined position further toward the blade parting line L2 of the lower die 2 with respect to the center of the space between the blade parting line L2 and the blade-side inner end edge of the bending block 26. The blade parting line L2 of the lower die 2 is located at a predetermined position further toward the blade parting line L1 with respect to the center of the space between the blade parting line L1 and the blade-side inner end edge of the bending block 16. The positional relationship between the blade 11 and the bending block 16 and the positional relationship between the blade 21 and the bending block 26 are symmetrical to each other. When the blade 11 is aligned with the bending block 16, the blade 21 is also aligned with the bending block 26.

After the upper and lower dies 1 and 2 are aligned with each other, the work (typically a metal plate) is placed on the lower die 2 for a pressing operation. The blade 11 of the upper die 1 folds the work to the right angle at an area they are in contact with each other by pressing into the space formed adjacent to the blade 21 of the lower die 2. The blade 11 is stopped when supported by the outside edge 13 of the blade 11 and the chamfered face 26C of the bending block 26. At the same time, the blade 21 of the lower die 2 folds the work to the right angle at an area they are in contact into the space formed adjacent to the blade 11 of the upper die 1. The blade 21 is stopped when supported by the outside edge 23 of the blade 21 and the chamfered face 16C of the bending block 16.

The angle formed by the blade parting line L1 and the outside edge 13 (e.g., 55 degrees) of the upper die 1 (having an angle of the blade edge 12 of, e.g., 90 degrees) is made larger than the angle formed by the blade parting line L1 and the inside edge 14 (e.g., 35 degrees). The angle formed by the blade parting line L2 and the outside edge 23 (e.g., 55 degrees) of the lower die 2 (having an angle of the blade edge 22 of, e.g., 90 degrees) is made larger than the angle formed by the blade parting line L2 and the inside edge 24 (e.g., 35 degrees). The upper die 1 is positioned such that the blade parting line L1 is located at a position further toward the blade parting line L2 of the lower die 2 with respect to the center of the space between the blade parting line L2 and the inner end edge of the bending block 26. The lower die 2 is positioned such that the blade parting line L2 is located at a position further toward the blade parting line L1 with respect to the center of the space between the blade parting line L1 and the inner end edge of the bending block 16. With this configuration, both ends of the work may be extended at the smallest angle with respect to the horizontal direction from a folding point during the folding operation. The space between the blade 11 and the bending block 16 may be increased such that the inner end edge of the bending block 16 is located further outside the center with respect to the outside edge 23 of the lower die 2. The space between the blade 21 and the bending block 26 may be increased such that the inner end edge of the bending block 26 is located further outside the center with respect to the outside edge 13 of the upper die 1. With this configuration, the above-described advantageous effect may further be enhanced. With this bending tool, elongated works, compared with materials of standard length, may be bent without causing collisions with mechanical parts or the neighborhood thereof.

The angle formed by the blade parting line L1 and the outside edge 13 of the upper die 1 is made larger than the angle formed by the blade parting line L1 and the inside edge 14. The angle formed by the blade parting line L2 and the outside edge 23 of the lower die 2 is made larger than the angle formed by the blade parting line L2 and the inside edge 24. The blade edge of the upper die 1 folds the work at an area they are in contact with each other by pressing into the space formed adjacent to the blade 21. The blade edge of the lower die 2 folds the work at an area they are in contact with each other by pressing into the space formed adjacent to the blade 11. With this configuration, the bending operation is a gradual process and thus the work is not likely to be damaged.

With this bending machine, the work, especially the lower end thereof, is gradually moved downward from the horizontal direction at a non-acute angle during the bending operation, which may be safe to the operating personnel. This advantageous effect may be enhanced if the space between the blade 11 and the bending block 16 of the upper die 1 is increased such that the inner end edge of the bending block 16 is located further outside the center with respect to the outside edge 23 of the lower die 2 and the space between the blade 21 and the bending block 26 of the lower die 2 is increased such that the inner end edge of the bending block 26 is located further outside the center with respect to the outside edge 13 of the upper die 1.

During the relative movement of the upper and lower dies 1 and 2, since the blade edges 12 and 22 press the work at positions where they are close to each other, the dies are not likely to be displaced from each other during the pressing operation even if the lower die is fastened to the table only with a screw.

Figure 2:
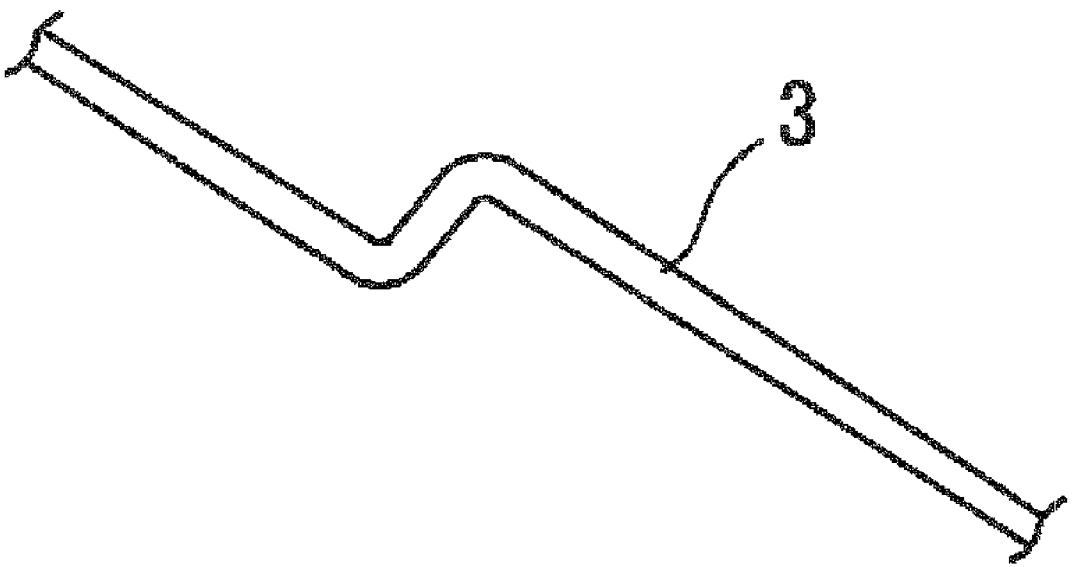
FIG. 2 is a side view of a work which is bent into a Z-shaped section by the bending tool.

In this manner, the Z-shaped fitting 3 as shown, for example, in FIG. 2 is obtained.

The dimension of the step (indicated by H in FIG. 1) of the Z-shaped fitting 3 may be changed by increasing or decreasing the space between the blade 11 and the bending 16 and the space between the blade 21 and the bending block 26. In particular, the number of the spacers 17 in the upper die 1 may be changed so as to position the blade 11 along a direction to move toward and away from the bending block 16, thereby changing the length of the space between the blade 11 and the bending block 16. Similarly, the number of the spacers 27 in the lower die 2 may be changed so as to position the blade 21 along a direction to move toward and away from the bending block 26, thereby changing the length of the space between the blade 21 and the bending block 26. With this configuration, the Z-shaped fitting 3 of varying dimension of the step may be obtained. If all the spacers 17 are eliminated, the inside edge 14 of the blade 11 and the chamfered face 16C of the bending block 16 abut directly to provide a Z-shaped fitting of the smallest dimension of the step. If all the spacers 27 are eliminated, the inside edge 24 of the blade 21 and the chamfered face 26C of the bending block 26 abut directly to provide a Z-shaped fitting of the smallest dimension of the step.

As described above, the upper die 1 has the blade edge 12 of 90 degrees, the angle formed by the blade parting line L1 and the outside edge 13 is 55 degrees, which is larger than the angle formed by the blade parting line L1 and the inside edge 14 of 35 degrees, the lower die 2 has the blade edge 22 of 90 degrees and the angle formed by the blade parting line L2 and the outside edge 23 is 55 degrees, which is larger than the angle formed by the blade parting line L2 and the inside edge 24 of 35 degrees. The upper die 1 is positioned such that the blade parting line L1 is located at a position further toward the blade parting line L2 of the lower die 2 with respect to the center of the space between the blade parting line L2 and the inner end edge of the bending block 26. The lower die 2 is positioned such that the blade parting line L2 is located at a position further toward the blade parting line L1 with respect to the center of the space between the blade parting line L1 and the inner end edge of the bending block 16. With this configuration, both ends of the work may be extended at the smallest angle with respect to the horizontal direction from a folding point during the folding operation. With this bending tool, elongated (compared with materials to be processed of standard length) works may be reliably bent without causing collisions with mechanical parts or the neighborhood thereof. The space between the blade 11 and the bending block 16 may be increased such that the inner end edge of the bending block 16 is located further outside the center with respect to the outside edge 23 of the lower die 2. The space between the blade 21 and the bending block 26 may be increased such that the inner end edge of the bending block 26 is located further outside the center with respect to the outside edge 13 of the upper die 1. With this configuration, the above-described advantageous effect may further be enhanced.

In this bending tool, the angle formed by the blade parting line L1 and the outside edge 13 of the upper die 1 is made larger than the angle formed by the blade parting line L1 and the inside edge 14 and the angle formed by the blade parting line L2 and the outside edge 23 of the lower die 2 is made larger than the angle formed by the blade parting line L2 and the inside edge 24. The blade edge 12 of the upper die 1 folds the work at an area they are in contact with each other by pressing into the space formed adjacent to the blade 21. The blade edge of the lower die 2 folds the work at an area they are in contact with each other by pressing into the space formed adjacent to the blade 11. With this configuration, the bending operation is a gradual process and thus the work is not likely to be damaged.

With this bending machine, the work, especially the lower end thereof, is gradually moved downward from the horizontal direction at a non-acute angle during the bending operation, which may be safe to the operating personnel. This advantageous effect may be enhanced if the space between the blade 11 and the bending block 16 of the upper die 1 is increased such that the inner end edge of the bending block 16 is located further outside the center with respect to the outside edge 23 of the lower die 2 and the space between the blade 21 and the bending block 26 of the lower die 2 is increased such that the inner end edge of the bending block 26 is located further outside the center with respect to the outside edge 13 of the upper die 1.

During the relative movement of the upper and lower dies 1 and 2, since the blade edges 12 and 22 press the work at positions where they are close to each other, the dies are not likely to be displaced from each other during the pressing operation even if the lower die is fastened to the table only with a screw. Since the dies are not likely to be displaced from each other, the metal mold may be elongated or a plurality of metal molds may be connected so as to extend the bending length.

Although the upper die 1 has the blade edge 12 of 90 degrees, the angle formed by the blade parting line L1 and the outside edge 13 is 55 degrees, which is larger than the angle formed by the blade parting line L1 and the inside edge 14 of 35 degrees, the lower die 2 has the blade edge 22 of 90 degrees and the angle formed by the blade parting line L2 and the outside edge 23 is 55 degrees, which is larger than the angle formed by the blade parting line L2 and the inside edge 24 of 35 degrees, these angles are not limited to the same. These angles may be appropriately determined so long as the angle formed by the blade parting line L1 and the outside edge 13 is larger than the angle formed by the blade parting line L1 and the inside edge 14, and the angle formed by the blade parting line L2 and the outside edge 23 is larger than the angle formed by the blade parting line L2 and the inside edge 24.

Although the blade edges 12 and 22 have the angle of 90 degrees, the invention is not limited to the same. The blade edge angle may vary around 90 degrees so long as the angle formed by the blade parting line L1 and the outside edge 13 is appropriately determined to be larger than the angle formed by the blade parting line L1 and the inside edge 14, and the angle formed by the blade parting line L2 and the outside edge 23 is appropriately determined to be larger than the angle formed by the blade parting line L2 and the inside edge 24.

Although the bending blocks 16 and 26 are formed integrally with the die bodies 10 and 20 and the blades 11 and 21 are removably attached to the die bodies 10 and 20, respectively, the invention is not limited to the same. As disclosed in Japanese Patent No. 1707773 mentioned above, the blade 11 may be formed integrally with the die body 10, the blade 21 may be formed integrally with the die body 20, the bending block 16 may be removably attached to the die body and the bending block 26 may be removably attached to the die body 20. Alternatively, the bending block 16 may be removably attached to the die body 10 in the upper die 1 while the blade 21 may be removably attached to the die body 20 and the bending block 26 may be formed integrally with the die body 20 in the lower die 2. Further alternatively, the upper die 1 may include the bending block 16 formed integrally with the die body 10 while the lower die 2 may include the blade 21 formed integrally with the die body 20, or the lower die 2 may include the bending block 26 formed integrally with the die body 20 while the upper die 1 may include the blade 11 formed integrally with the die body 10.

Although the invention has been described in conjunction with the preferred embodiment, it will be understood that a person skilled in the art can make various modifications without departing from the spirit and scope of the invention.

What is claimed is:

1. A bending tool for bending press comprising two dies each of which includes:

a die body, a blade provided at one end of the die body and having an outside edge, an inside edge, and a blade edge of a predetermined angle which angle is bisected by a vertical blade parting line, and a press bending block, the press bending block comprising a blade-side inner end edge and an outer edge opposite the blade-side inner end edge, the press bending block being provided at the end of the die body in a laterally separated relationship from the blade on an opposite side of the blade parting line, the bending block and the blade together defining a space therebetween extending along a direction substantially perpendicular to an edge surface of the blade, and wherein the dies oppose each other in a position such that the blade parting line of a first one of the dies is located at a position between the blade of a second one of the dies and a center of the a space between a blade and the bending block of the second one of the dies, wherein:

an angle formed by the blade parting line and the outside edge of the blade on a side opposite to the bending block of each die is larger than an angle formed by the blade parting line and the inside edge of the blade; and the blade parting line of the first one of the dies is located at a position closer to the blade parting line of the second one of the dies than the blade parting line of the first one of the dies is to the blade-side inner end edge of the bending block of the second one of the dies.

2. A bending tool for bending press according to claim 1, wherein the blade-side inner end edge of the bending block is chamfered and a length of the inside edge of the blade is shorter than a length of the chamfered face of the bending block.

3. A bending tool for bending press according to claim 1, wherein the space between the blade and the bending block of a first one of the dies is increased such that the blade-side inner end edge of the bending block of the first one of the dies is located further away from the center of the space between the blade and the bending block than the outside edge of a second one of the dies.

4. A bending tool for bending press according to claim 1, wherein the blade edge has an angle of substantially 90 degrees, an angle formed by the blade parting line and the outside edge is 55 degrees and an angle formed by the blade parting line and the inside edge is 35 degrees.

* * * * *